US009073309B1

(12) United States Patent
Murayama et al.

(10) Patent No.: US 9,073,309 B1
(45) Date of Patent: Jul. 7, 2015

(54) APPARATUS AND METHOD FOR RECORDING

(71) Applicant: CANON KABUSHIKI KAISHA, Tokyo (JP)

(72) Inventors: Yoshiaki Murayama, Tokyo (JP); Minoru Teshigawara, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/562,551

(22) Filed: Dec. 5, 2014

(30) Foreign Application Priority Data

Dec. 12, 2013 (JP) ..... 2013-257154

(51) Int. Cl.
*B41J 29/38* (2006.01)
*B41J 2/045* (2006.01)

(52) U.S. Cl.
CPC ..... *B41J 2/04505* (2013.01)

(58) Field of Classification Search
USPC ..... 347/5, 9, 12, 15, 19
See application file for complete search history.

(56) References Cited

U.S. PATENT DOCUMENTS

2004/0160468 A1* 8/2004 Kim et al. ..... 347/12
2010/0033525 A1* 2/2010 Kunihiro ..... 347/12

FOREIGN PATENT DOCUMENTS

JP 2005-138374 A 6/2005
JP 2008-175966 A 7/2008
JP 2010-105203 A 5/2010

* cited by examiner

*Primary Examiner* — Lam Nguyen
(74) *Attorney, Agent, or Firm* — Canon USA, Inc., IP Division

(57) ABSTRACT

A recording apparatus includes a recording control unit and an adjusting unit. The recording control unit controls a recording head so that a plurality of alignment measuring patterns are recorded between recording areas of images at predetermined intervals with first and second nozzle arrays. The patterns are used to obtain information on the amount of misalignment between a position of recording with the first nozzle array and a position of recording with the second nozzle array. After the patterns are recorded, the images are recorded with the first and second nozzle arrays. In recording images after the recording of the patterns, the adjusting unit adjusts the relative recording positions of the first nozzle array and the second nozzle array on a basis of an amount of misalignment between the recording positions of the first nozzle array and the second nozzle array.

21 Claims, 15 Drawing Sheets

APPARATUS AND METHOD FOR RECORDING

BACKGROUND OF THE INVENTION

1. Field of the Invention

The present invention(s) relate to at least one apparatus and at least one method for recording.

2. Description of the Related Art

Nozzle arrays of general ink-jet printers are arranged at intervals, and thus, a difference in ink ejection timing due to the intervals is adjusted. In full-line ink-jet printers, a plurality of heads for different colors are arranged in a recording-medium conveying direction, so that the distance between the heads is large, thus causing a significant difference in ejection timing when a conveyance error has occurred. This causes image degradation, such as distortion of line images and a change in color tone. Japanese Patent Laid-Open No. 2005-138374 discloses a related technique for adjusting a recording position by detecting deviation of landing due to a conveyance error and by correcting ejection timing during recording. Japanese Patent Laid-Open No. 2008-175966 discloses a related technique for recording a pattern for detecting deviation of landing between images and determining the length of the detecting-pattern formed area in the conveying direction depending on the operating environment (temperature and cumulated operating time).

However, it is known that the conveyance error changes because of factors other than the operating environment. Specifically, the conveyance error may change depending on the moisture state, the kind, and the width of paper, and so on. These factors cause a change in the hardness of the paper and friction between conveying rollers and the paper to change the conveying speed. Therefore, merely determining the detection pattern on the basis of the cumulated operating time, as disclosed in Japanese Patent Laid-Open No. 2008-175966, leads to a concern about an excessive increase in the detecting-pattern formation area, thus increasing the consumption of the recording medium. Another concern is that a necessarily and sufficiently long detecting-pattern formation area cannot be ensured, which causes the detection pattern and recorded images to partially overlap, resulting in inaccurate detection of the recording position.

SUMMARY OF THE INVENTION

The present invention(s) provide at least one recording apparatus, and method(s) for recording with one or more recording apparatuses, capable of forming a detection pattern in a suitable area while reducing consumption of a recording medium.

The present invention(s) provide at least one recording apparatus including a plurality of ink ejecting nozzles, a recording control unit, an acquisition unit, and an adjusting unit. The ink ejecting nozzles may be arrayed in a first direction. The nozzles may have a first nozzle array and a second nozzle array disposed in a second direction perpendicular to the first direction. The recording apparatus may eject ink from the nozzles of the first nozzle array and the second nozzle array to record images on a recording medium while conveying the recording medium in the second direction. The recording control unit may control recording with the first and second nozzle arrays so that a plurality of alignment measuring patterns are recorded between recording areas of the images on the recording medium at predetermined intervals. The patterns may be used to obtain information on the amount of misalignment in the second direction on the recording medium between a position of recording with the first nozzle array and a position of recording with the second nozzle array. After the patterns are recorded, the plurality of images may be recorded upstream from the recording areas of the patterns in the second direction, respectively. The acquisition unit may obtain the information on the basis of the result of reading the patterns. In recording with the first nozzle array and the second nozzle array performed after the recording of a first pattern of the patterns, the adjusting unit may adjust the relative recording positions of the first nozzle array and the second nozzle array on the basis of the information obtained by the acquisition unit and the corresponding amount of misalignment. If the acquisition unit cannot obtain the information on the basis of the result of reading the first pattern, the adjusting unit may not perform the adjustment, and the next time, the recording control unit may control the recording so that a second pattern is recorded in a recording area longer in the second direction than the recording area of the first pattern. If the acquisition unit obtains the information on the basis of the result of reading the first pattern, the adjusting unit may adjust the recording positions for the first pattern, and the next time, the recording control unit controls the recording on the basis of the adjustment with the adjusting unit so that a second pattern is recorded in a recording area shorter in the second direction than the recording area of the first pattern. Additionally or alternatively, if the first pattern overlaps with the images, the recording control unit may control the recording so that a recording area of a second pattern in the second direction is longer than the recording area of the first pattern in the second direction. According to other aspects of the present invention(s), other apparatuses and methods are discussed herein.

Further features of the present invention(s) will become apparent from the following description of exemplary embodiments with reference to the attached drawings.

DESCRIPTION OF THE EMBODIMENTS

Embodiments of the present invention will now be described in detail with reference to the attached drawings. In the following description, a recording apparatus that adopts an ink-jet recording method will be described by way of example. Examples of the recording apparatus include a single-function printer having only a recording function and a multifunction printer having a plurality of functions, such as a recording function, a facsimile function, and a scanner function. Other examples are manufacturing apparatuses for manufacturing color filters, electronic devices, optical devices, microstructures, and so on.

In the following description, "recording" refers to forming significant information, such as characters and figures, and insignificant information. "Recording" further includes forming images, designs, patterns, structures, and so on a recording medium so that humans can view, irrespective of whether or not it is an actualized matter, and processing a medium.

"Recording medium" refers to not only paper for use in general recording apparatuses but also fabrics, plastic film, metal plates, glass, ceramics, resin, wood, leather, and other materials that accept ink.

"Ink" should be broadly interpreted as in the definition of "recording" described above. Specifically, "ink" refers to liquid applied onto a recording medium to be used in forming images, designs, or patterns, processing the recording medium, or processing ink (for example, solidifying or insolubilizing coloring materials in the ink).

First Embodiment

Figure 1:
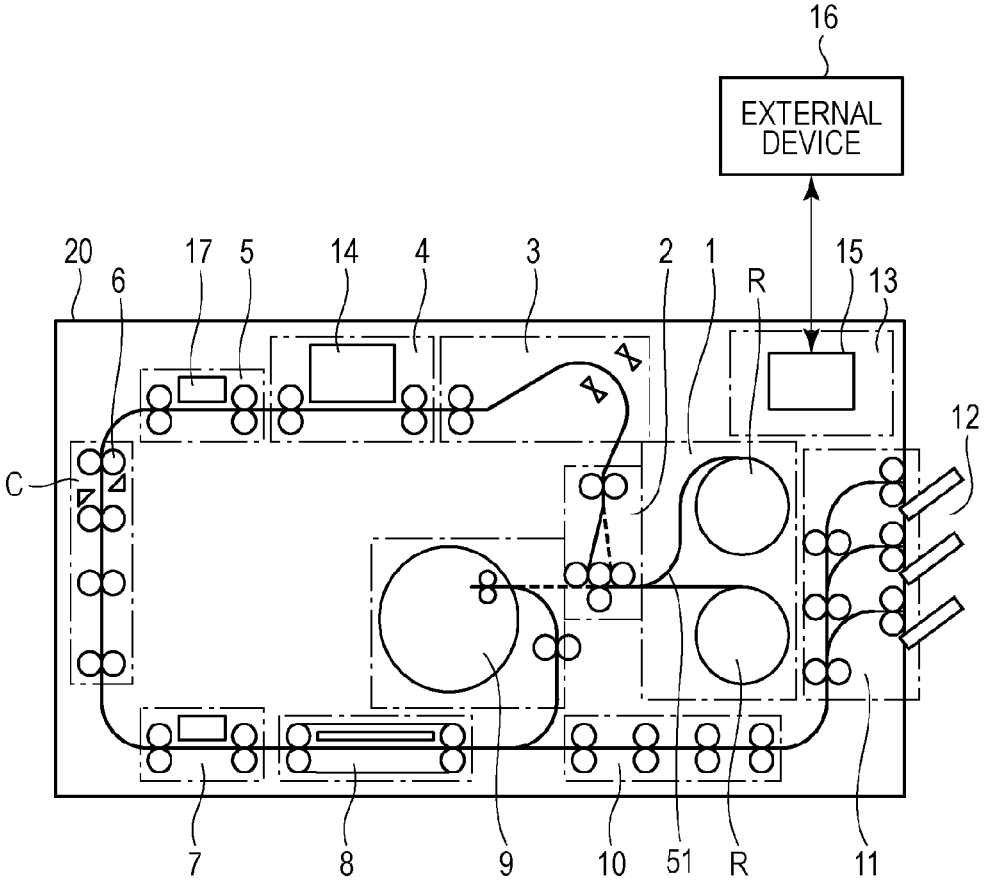
FIG. 1 is a diagram showing an example of the internal configuration of an ink-jet recording apparatus according to an embodiment of the present invention.

FIG. 1 is a diagram showing an example of the internal configuration of an ink-jet recording apparatus (hereinafter simply referred to as a recording apparatus) 20 according to an embodiment of the present invention. The recording apparatus 20 according to this embodiment will be described using a high-speed line printer that supports both single-sided recording and double-sided recording on a continuous roll sheet as an example. Such a recording apparatus is suitable for the field of a large volume of printing in printing laboratories, for example.

The recording apparatus 20 accommodates a sheet feeding unit 1, a decurling unit 2, a skew correcting unit 3, a recording unit 4, a checking unit 5, a cutter unit 6, an information recording unit 7, a drying unit 8, a sheet take-up unit 9, and a discharge conveying unit 10. The recording apparatus 20 further accommodates a sorter unit 11, an output tray 12, and a control section 13.

A recording medium (in this case, a sheet) is conveyed along a sheet conveying path (indicated by the solid line in FIG. 1) by a conveying mechanism including a roller pair and a belt. The components of the recording apparatus 20 perform various processes on the sheet on the conveying path.

The sheet feeding unit 1 accommodates a rolled continuous sheet 51 and feeds it. The sheet feeding unit 1 can accommodate two rolls R and selectively draws the continuous sheet 51 for feeding. The number of rolls to be accommodated may not necessarily be two; one or three or more rolls may be accommodated.

The decurling unit 2 reduces the curl (warp) of the sheet 51 fed from the sheet feeding unit 1. The decurling unit 2 curves the sheet 51 with two pinch rollers for each driving roller so as to give a reverse warp. This can reduce the curl of the sheet 51.

The skew correcting unit 3 corrects the skew (an inclination with respect to an initial advancing direction) of the sheet 51 that has passed through the decurling unit 2. The skew correcting unit 3 corrects the skew of the sheet 51 by pressing a reference end of the sheet 51 against a guide member.

The recording unit 4 forms an image on the conveyed sheet 51 for recording. The recording unit 4 includes a plurality of sheet conveying rollers and a plurality of ink-jet recording heads (hereinafter simply referred to as recording heads) 14. The recording heads 14 are full-line recording heads each having a recording width corresponding to the maximum width of a sheet to be used or longer than that so as to cover the maximum width of the sheet.

The recording heads 14 are arranged in parallel along the conveying direction. In this embodiment, four recording heads 14 corresponding to four colors, black (K), cyan (C), magenta (M), and yellow (Y), are disposed. The recording heads 14 are disposed in order of K, C, M, and Y from the upstream side in the sheet conveying direction, with their recording widths aligned along the sheet conveying direction. The number of colors and the number of recording heads may not necessarily be four and may be changed as necessary. Examples of the ink-jet system include a system using a heater element, a system using a piezoelectric element, a system using an electrostatic element, and a system using a microelectromechanical system (MEMS) element. The individual color inks are supplied from ink tanks to the recording heads 14 through ink tubes.

The checking unit 5 checks on reading of images with an optical sensor, for example, a CCD line sensor 17. An example of the CCD line sensor 17 is a two-dimensional image sensor, in which a plurality of reading elements are arranged in a direction perpendicular or substantially perpendicular to the sheet conveying direction (in the nozzle array direction). The checking unit 5 further includes a light-emitting element and so on. With such a configuration, the checking unit 5 optically reads patterns and images recorded on the sheet 51 by the recording unit 4 to check the state of the nozzles of the recording heads 14, the state of conveyance of the sheet 51, the position of the images, and so on.

The cutter unit 6 is a mechanism for cutting the sheet 51 on which images are recorded into a predetermined length of sheets 51 with a cutter C. The cutter unit 6 has a plurality of conveying rollers for feeding the sheets 51 to the next process.

The information recording unit 7 records a serial number, date, and other information on the back of the cut sheets 51. The drying unit 8 heats the sheet on which images are recorded by the recording unit 4 to dry the applied ink (in a short time). The drying unit 8 has a conveying belt for feeding the sheets 51 to the next process and conveying rollers.

The sheet take-up unit 9 temporarily takes up the continuous sheet 51 whose front surface has been printed at double-sided recording. The sheet take-up unit 9 includes a take-up drum that rotates to take up the sheet 51. After completion of recording on the front surface of the sheet 51, the continuous sheet 51 that is not cut by the cutter unit 6 is temporarily taken up by the take-up drum. After completion of the taking-up operation, the taken-up sheet 51 is fed to the recording unit 4 via the decurling unit 2. Since the sheet 51 is reversed inside out, the recording unit 4 can perform recording on the back of the sheet 51. A specific operation for double-sided recording will be described later.

The discharge conveying unit 10 conveys the sheets 51, which are cut by the cutter unit 6 and are dried by the drying unit 8, to the sorter unit 11. The sorter unit 11 discharges the sheets 51 on which images are recorded to the output tray 12. The sorter unit 11 may sort the sheets 51 to different output trays 12.

The control section 13 controls the components of the recording apparatus 20. The control section 13 includes a controller 15 having a CPU, a memory, various I/O interfaces, and so on, and a power source. The operation of the recording apparatus 20 is controlled by the controller 15 or in accordance with an instruction from an external device 16 (for example, a host computer) connected to the controller 15 via an I/O interface.

Figure 2A:
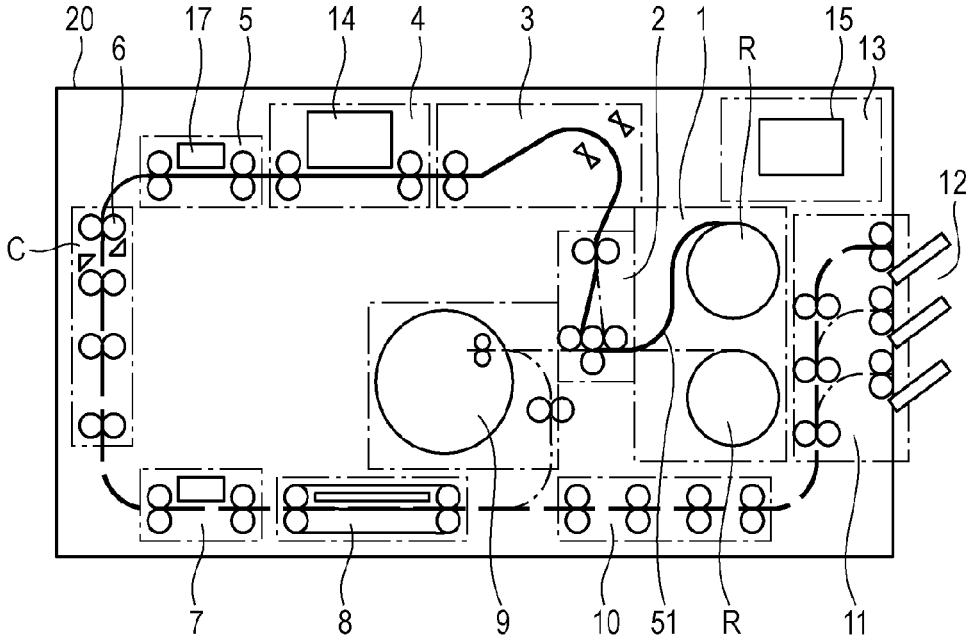
FIG. 2A is a diagram illustrating an operation sequence of single-sided recording.
Figure 2B:
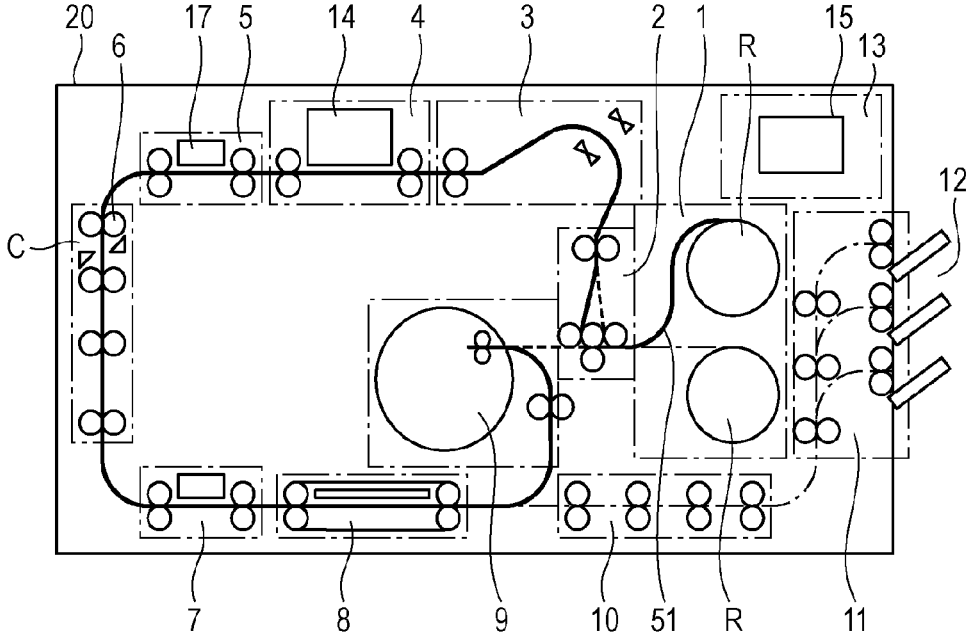
FIG. 2B is a diagram illustrating an operation sequence of double-sided recording.

Referring next to FIGS. 2A and 2B, the flow of the basic operation of the recording process will be described. Since the recording process differs between single-sided recording and double-sided recording, each of them will be described.

FIG. 2A is a diagram illustrating an operation sequence of single-sided recording. FIG. 2A shows a conveying path of the sheet 51, with a thick line, after it is fed by the sheet feeding unit 1 after images are recorded thereon until it is discharged to the output tray 12.

When the sheet 51 is fed from the sheet feeding unit 1, the sheet 51 is processed by the decurling unit 2 and the skew correcting unit 3. Thereafter, images are recorded on the surface of the sheet 51 by the recording unit 4. The sheet 51 on which images are recorded passes through the checking unit 5 and is cut into a predetermined length of sheets 51 by the cutter unit 6. The back of the cut sheets 51 is printed with information, such as date, by the recording unit 7 as necessary. Subsequently, the sheets 51 are dried by the drying unit 8 one by one and are then discharged onto the output tray 12 of the sorter unit 11 through the discharge conveying unit 10.

FIG. 2B is a diagram illustrating an operation sequence of double-sided recording. In double-sided recording, a recording sequence for the back surface of the sheet 51 is executed after a recording sequence for the front surface of the sheet 51. FIG. 2B shows a conveying path, with a thick line, when images are recorded on the front surface of the sheet 51 during double-sided recording.

The operations from the sheet feeding unit 1 to the checking unit 5 are the same as those for single-sided recording described using FIG. 2A. Differences are the process performed by the cutter unit 6 and subsequent processes. Specifically, when the sheet 51 is conveyed to the cutter unit 6, the cutter unit 6 does not cut the continuous sheet 51 at predetermined intervals but cuts the trailing end of the recording area of the continuous sheet 51. When the sheet 51 is conveyed to the drying unit 8, the drying unit 8 dries ink on the front surface of the sheet 51 and then conveys the sheet 51 not to the discharge conveying unit 10 but to the sheet take-up unit 9. The conveyed sheet 51 is taken up by the take-up drum of the sheet take-up unit 9 that rotates in a forward direction (in FIG. 2B, counterclockwise). In other words, the whole of the sheet 51 to the trailing end (cut position) is taken up by the take-up drum. Part of the continuous sheet 51 upstream in the conveying direction from the cut position of the sheet 51 cut by the cutter unit 6 is rewound to the sheet feeding unit 1 so that the leading end (cut position) of the sheet 51 is not left in the decurling unit 2.

After completion of the recording sequence for the front surface of the sheet 51, the recording sequence for the back surface is started. When this sequence is started, the take-up drum rotates in the opposite direction to the direction during the taking-up operation (in FIG. 2B, clockwise). An end of the taken-up sheet 51 (the trailing end during taking-up, which is a leading end during feeding), is conveyed to the decurling unit 2. The decurling unit 2 corrects the curl of the sheet 51 opposite to that at recording on the front surface of the sheet 51. This is because the sheet 51 wound on the take-up drum is reversed inside out from the rolls R in the sheet feeding unit 1, and thus, the curl is a reversed curl.

The sheet 51 is then conveyed to the skew correcting unit 3 and to the recording unit 4, where images are recorded on the back surface of the sheet 51. The sheet 51 on which images are recorded passes through the checking unit 5 and is cut into a predetermined length of sheets 51 by the cutter unit 6. Since images are recorded on both sides of the cut sheets 51, the information recording unit 7 does not record information, such as date. The sheets 51 then pass through the drying unit 8 and the discharge conveying unit 10 and are discharged to the output tray 12 of the sorter unit 11.

Figure 3:
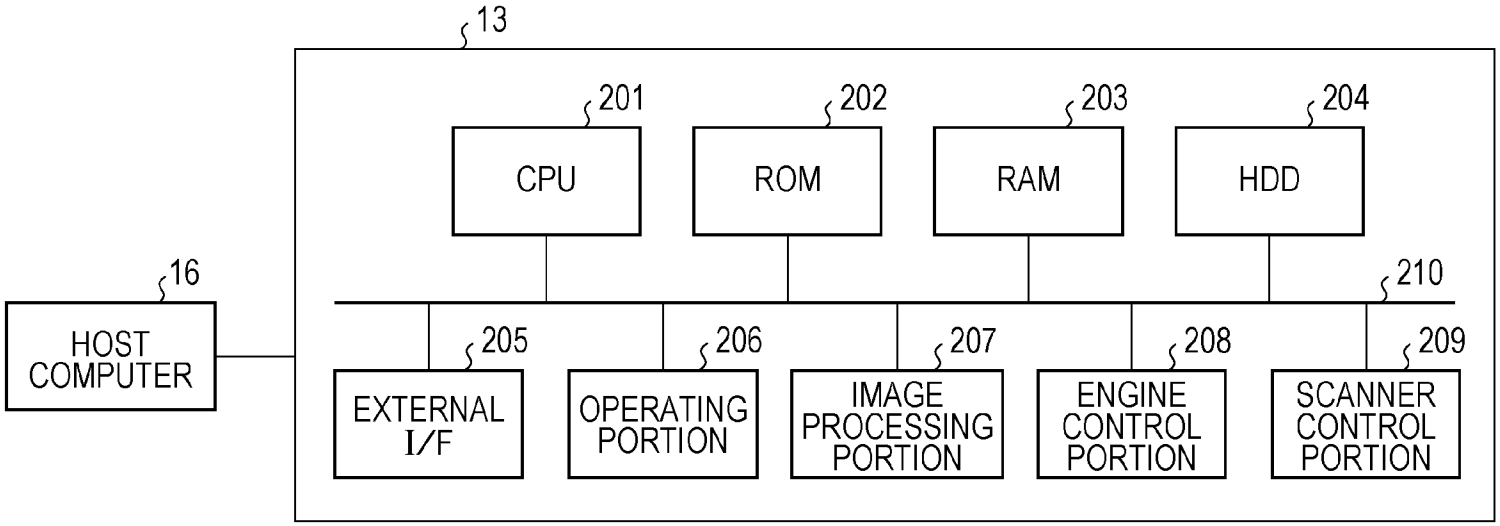
FIG. 3 is a block diagram illustrating the configuration of a control section shown in FIG. 1.

FIG. 3 is a block diagram illustrating the control section 13 according to the first embodiment. The control section 13 mainly includes a CPU 201, a ROM 202, a RAM 203, an image processing portion 207, an engine control portion 208, and a scanner control portion 209. The control section 13 connects to a HDD 204, an operating portion 206, and an external I/F 205 through a system bus 210.

The CPU 201 is a central processing unit with a microprocessor (microcomputer) configuration and is included in the control section 13 shown in FIG. 1. The CPU 201 controls the overall operation of the recording apparatus 20 by executing programs and operating hardware. The ROM 202 stores fixed data necessary for the programs for the CPU 201 and various operations of the recording apparatus 20. The RAM 203 is used as a work area for the CPU 201, as a temporal storage area for various items of receive data, and as a storage for various items of set data. The HDD 204 can store programs for the CPU 201, print data, and setting information necessary for various operations of the recording apparatus 20 in a built-in harddisk and can read them. Another mass storage may be used instead of the HDD 204.

The operating portion 206 includes hard keys or a touch panel for a user to perform various operations and a display unit (not shown) for presenting (notifying) various items of information to the user. The operating portion 206 corresponds to the controller 15 in FIG. 1. Presentation of information to the user can also be performed by outputting sound (beeping sound, voice, or the like) based on sound information from a sound generator.

The image processing portion 207 develops (converts) print data that the recording apparatus 20 deals with (for example, data expressed in a page description language) to image data (a bitmapped image) and performs image processing. The image processing portion 207 converts the color space (for example, YCbCr) of image data included in input print data to a standard RGB color space (for example, sRGB). Furthermore, the image processing portion 207 performs various image processing operations, such as conversion of resolution to an effective number of pixels (that the recording apparatus 20 can provide), image analysis, and image correction, on the image data as necessary. Image data obtained by such image processing operations is stored in the RAM 203 or the HDD 204.

The engine control portion 208 functions as a recording control unit that controls the process of printing an image based on print data on a sheet in response to a control command received from the CPU 201 or the like. The engine control portion 208 gives an instruction to eject ink to the recording heads 14 for individual colors, sets ejection timing to adjust dot positions (ink landing positions) on a recording medium, and makes an adjustment based on the driving state of the heads. The engine control portion 208 controls driving of the recording heads 14 in accordance with print data to eject ink from the recording heads 14, thereby forming an image on the sheet 51. The engine control portion 208 controls paper feed rollers and conveying rollers, such as giving an instruction to drivepaper feed rollers and an instruction to drive conveying rollers, and obtaining the rotation states of the conveying rollers, to convey the sheet 51 at an appropriate speed through an appropriate path or stops the sheet 51.

The scanner control portion 209 controls an image sensor in accordance with a control command received from the CPU 201 or the like to read images on the sheet 51 to acquire analog luminance data on red (R), green (G), and blue (B), and converts the analog luminance data to digital data. Examples of the image sensor include a CCD image sensor and a CMOS image sensor. The image sensor may be either a linear image sensor or an area image sensor. The scanner control portion 209 gives an instruction to operate the image sensor, obtains the state of the image sensor based on the operation, and analyzes the luminance data obtained from the image sensor to detect an ejection failure of ink ejected from the recording heads 14 and sheet cut positions. Sheets 51 that are determined to be accurately printed with images by the scanner control portion 209 are subjected to the process of drying ink on the sheets 51 and are then discharged onto a tray 12 of the sorter unit 11.

The host computer 16 (the external device, described above) is a device connected outside the recording apparatus 20 and serving as an image-data supply source for the recording apparatus 20 to perform printing and issues various print job orders. The host computer 16 may be a general-purpose personal computer (PC) or another type of data supply device. An example of the other type of data supply device is an image capture device that captures images and generates image data. Examples of the image capture device include a reader (scanner) that reads images on a document to create image data and a film scanner that reads a negative film or a positive film to create image data. Other examples of the image capture device include a digital camera that acquires a still image to create digital image data and a digital video camera that acquires a moving image to create moving image data. Alternatively, a photo storage on a network or a socket into which a portable removable memory inserted may be provided to allow an image file stored in the photo storage or the portable memory to be read into image data for printing. Instead of the general PC, various kinds of data supply device, such as a terminal specifically for recording apparatuses, may be provided. These data supply devices may be included in the recording apparatus 20 or may be another device connected outside the recording apparatus 20. If the host computer 16 is a PC, the PC stores an OS, application software for creating image data, and a printer driver for the recording apparatus 20 in a storage. The printer driver controls the recording apparatus 20 and converts image data supplied from the application software to a format that the recording apparatus 20 can deal with to create print data. It is also possible that after print data is converted to image data by the host computer 16, the image data is supplied to the recording apparatus 20. Not all of the above processes need to be implemented by software; part or all of them may be implemented by hardware. Image data, commands, and status signals supplied from the host computer 16 can be transmitted to or received from the recording apparatus 20 via the external I/F 205. The external I/F 205 may be either a local I/F or a network I/F. The external I/F 205 may adopt either wired connection or wireless connection.

The above components in the recording apparatus 20 are connected to communicate with one another through the system bus 210. While in the above examples, one CPU 201 controls all the components in the recording apparatus 20 shown in FIG. 1, other configurations are possible. In other words, some of the functional blocks may each have a CPU so as to be controlled by the individual CPUs. The functional blocks may have various configurations other than that shown in FIG. 2A and FIG. 2B; for example, the functional blocks may be appropriately divided into separate processing units or control units or may be appropriately combined. Reading of data from the memory may be performed using a direct memory access controller (DMAC).

Figure 4:
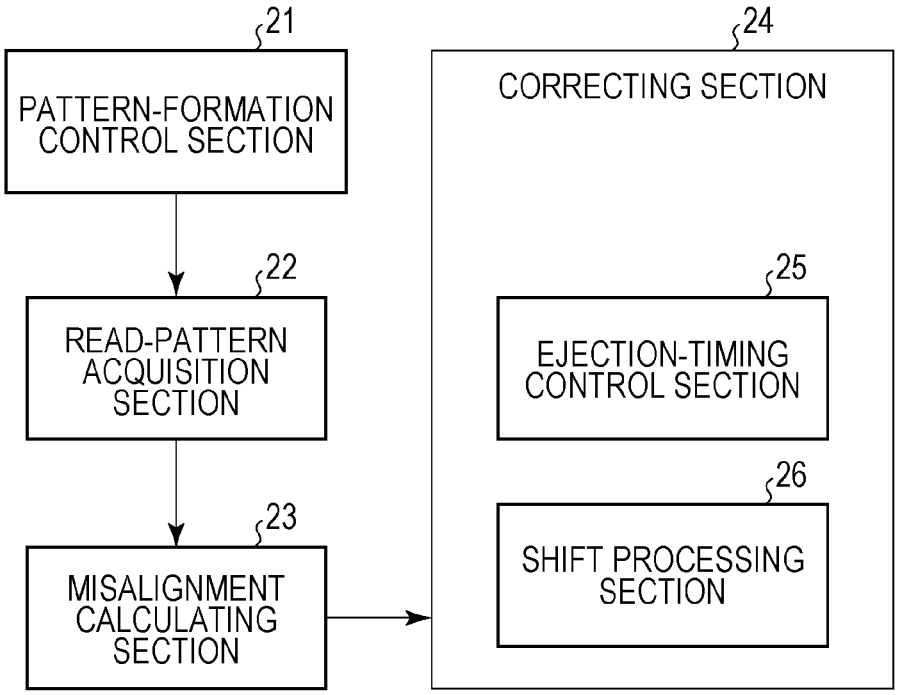
FIG. 4 is a diagram showing an example of a functional configuration implemented by the control section in FIG. 1.

Referring to FIG. 4, an example of a functional configuration implemented by the engine control portion 208 shown in FIG. 3 will be described. The functional configuration shown in FIG. 4 is implemented by, for example, the CPU reading and executing a program stored in a memory or the like.

The engine control portion 208 includes, as a functional configuration, a pattern-formation control section 21, a read-pattern acquisition section 22, a misalignment calculating section 23, and a correcting section 24.

The pattern-formation control section 21 functions as a recording control unit for controlling recording of misalignment measuring patterns for measuring the amounts of misalignment of the landing positions (attachment positions) of ink ejected from the individual nozzle arrays of the recording heads 14. The details of the misalignment measuring patterns will be described later with reference to FIG. 7.

The read-pattern acquisition section 22 obtains misalignment measuring patterns recorded on a recording medium (sheet). The misalignment measuring pattern is read using a reading device, such as a CCD line sensor 17, provided in the checking unit 5.

The misalignment calculating section 23 calculates the amounts of misalignment in the recording heads 14 and among the recording heads 14, which is caused by a production error, an installation error, or the like, on the basis of the result of reading the recording-position-misalignment measuring pattern. In other words, the misalignment calculating section 23 calculates the amounts of misalignment of actual landing positions of ink relative to ideal ink landing positions.

The correcting section 24 functions as an adjusting unit that adjusts the recording positions of the nozzle arrays of the individual recording heads 14 by correcting misalignment of the landing positions of ink ejected from the nozzles of the individual recording heads 14 on the basis of the amounts of misalignment calculated by the misalignment calculating section 23. The correction performed by the correcting section 24 is applied also to recording of a recording-position-misalignment measuring pattern performed after the correction. The correcting section 24 includes an ejection-timing control section 25 that controls the ejection timing of ink from the individual nozzles and a shift processing section 26 that shifts the areas of the nozzles for use in recording. This is a description of an example of the functional configuration implemented by the control section 13.

Figure 5:
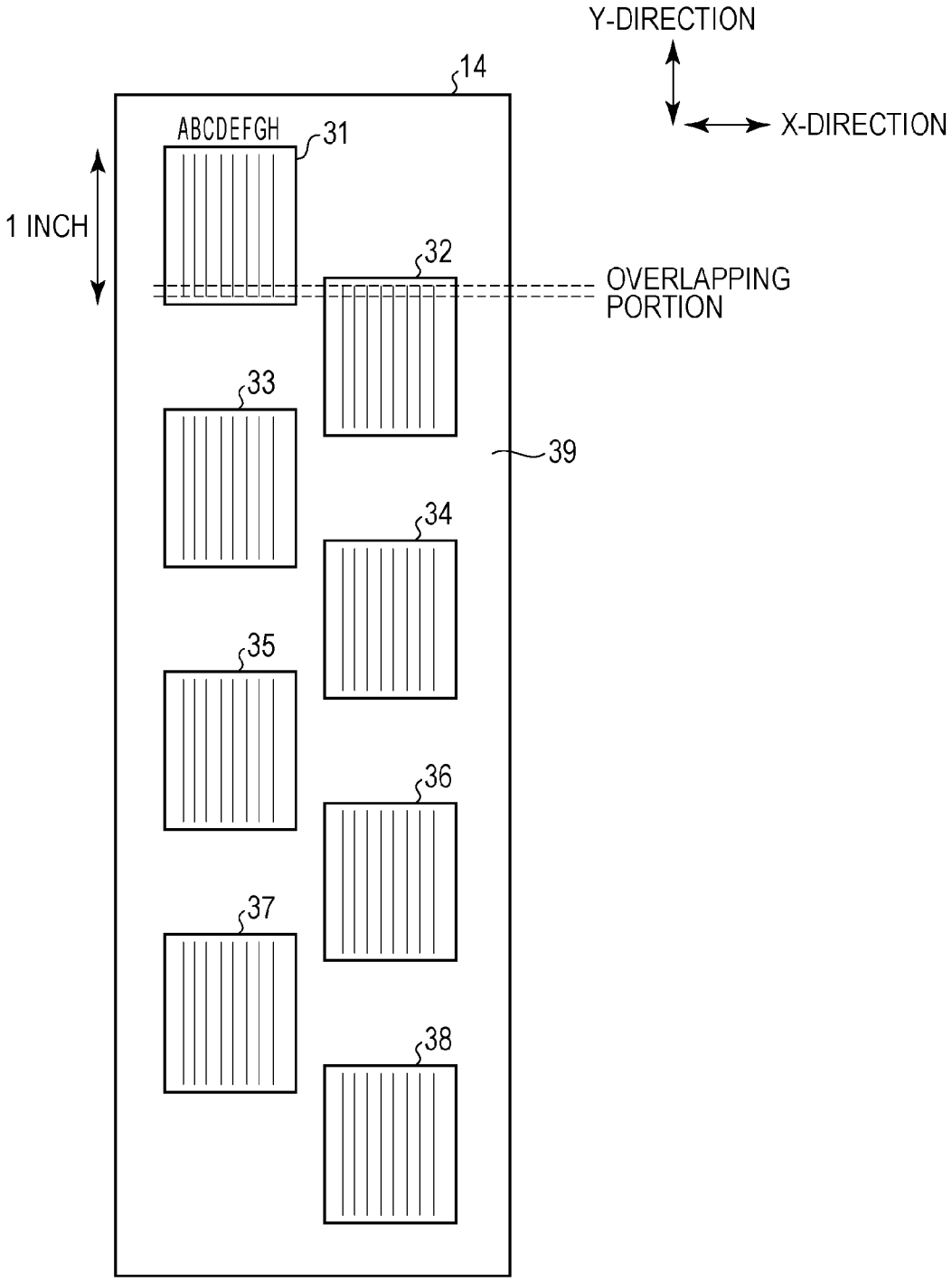
FIG. 5 is a diagram showing an example of the configuration of a recording head.

Referring next to FIG. 5, an example of the configuration of the recording heads 14 of the recording apparatus 20 illustrated in FIG. 1 will be described. The recording heads 14 are constituted by four color recording heads (black (K), cyan (C), magenta (M), and yellow (Y)). A direction along the sheet conveying direction is defined as an X-direction, and a direction perpendicular to the sheet conveying direction is defined as a Y-direction. Also in the subsequent drawings, the definitions of the X-direction and the Y-direction are the same as above. Since the plurality of recording heads 14 corresponding to the individual colors have the same configuration, one of the plurality of recording heads 14 corresponding to one color will be described by way of example.

The recording head 14 includes eight chips 31 to 38. The chips 31 to 38 each have a nozzle member layered on, for example, a silicon substrate, and have an effective ejection width of 1 meter in the Y-direction in FIG. 5. The chips 31 to 38 are disposed in a staggered configuration on a base substrate (not shown) serving as a supporting member. The chips 31 to 38 are electrically connected to a flexible wiring board (not shown) with electrodes (not shown) provided at both ends in the nozzle array direction (Y-direction) by wire bonding.

The individual chips 31 to 38 each have a plurality of nozzle arrays in which nozzles for ejecting ink are arrayed in a predetermined direction (in this case, in the Y-direction) in the X-direction perpendicular to the Y-direction. More specifically, eight nozzle arrays (a nozzle array A, a nozzle array B, a nozzle array C, a nozzle array D, a nozzle array E, a nozzle array F, a nozzle array G, and a nozzle array H) are disposed in parallel. The chips 31 to 38 overlap with each other by a predetermined number of nozzles. More specifically, part of the nozzles of the nozzle arrays A to H of adjacent chips overlap with each other in the Y-direction (in the nozzle array direction).

The chips 31 to 38 each have a temperature sensor (not shown) for measuring the temperature of the chips 31 to 38. The nozzles (ejection ports) each have a recording element (a heater) formed of, for example, a heating resistor. The recording elements foam ink by electric heating to cause the ink to be ejected through the ejection ports with their motion energy.

The recording heads 14 have an effective ejection width of about 8 inches, which covers the short side of an A4 recording medium, thus allowing recording of images to be completed by one scanning.

Figure 6:
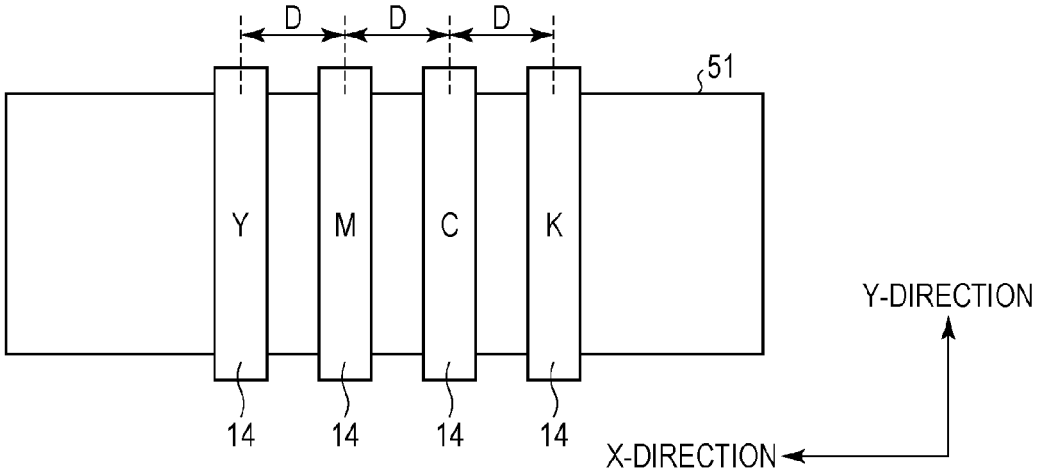
FIG. 6 is a diagram illustrating the layout of a plurality of recording heads.

Referring next to FIG. 6, misalignment of landing positions of ink ejected from the recording heads 14 shown in FIG. 5 during recording will be described. The recording heads 14 are arranged by color at intervals of D in the X-direction. When the sheet 51 is conveyed over the individual recording heads 14, ink is ejected from the recording heads 14 onto the sheet 51 to record an image. A change in conveying speed while the sheet 51 is conveyed causes misalignment of the landing positions of ink ejected from the recording heads 14 of respective colors. The head 14 for K at the uppermost stream position in the conveying direction (X-direction) and the head 14 for Y in the lowermost stream position in the X-direction form a most distant combination in the X-direction, which causes misalignment of landing due to a change in conveying speed to be larger than that of the other combinations. The large misalignment of landing may cause visual misaligned characters or lines, a color shift of an image formed of a plurality of colors. Thus, this embodiment has a system for reducing degradation of image quality by measuring the amounts of misalignment of recording positions among the recording heads 14 for respective colors during recording and correcting the recording positions on the basis of the measurement result.

Figure 7:
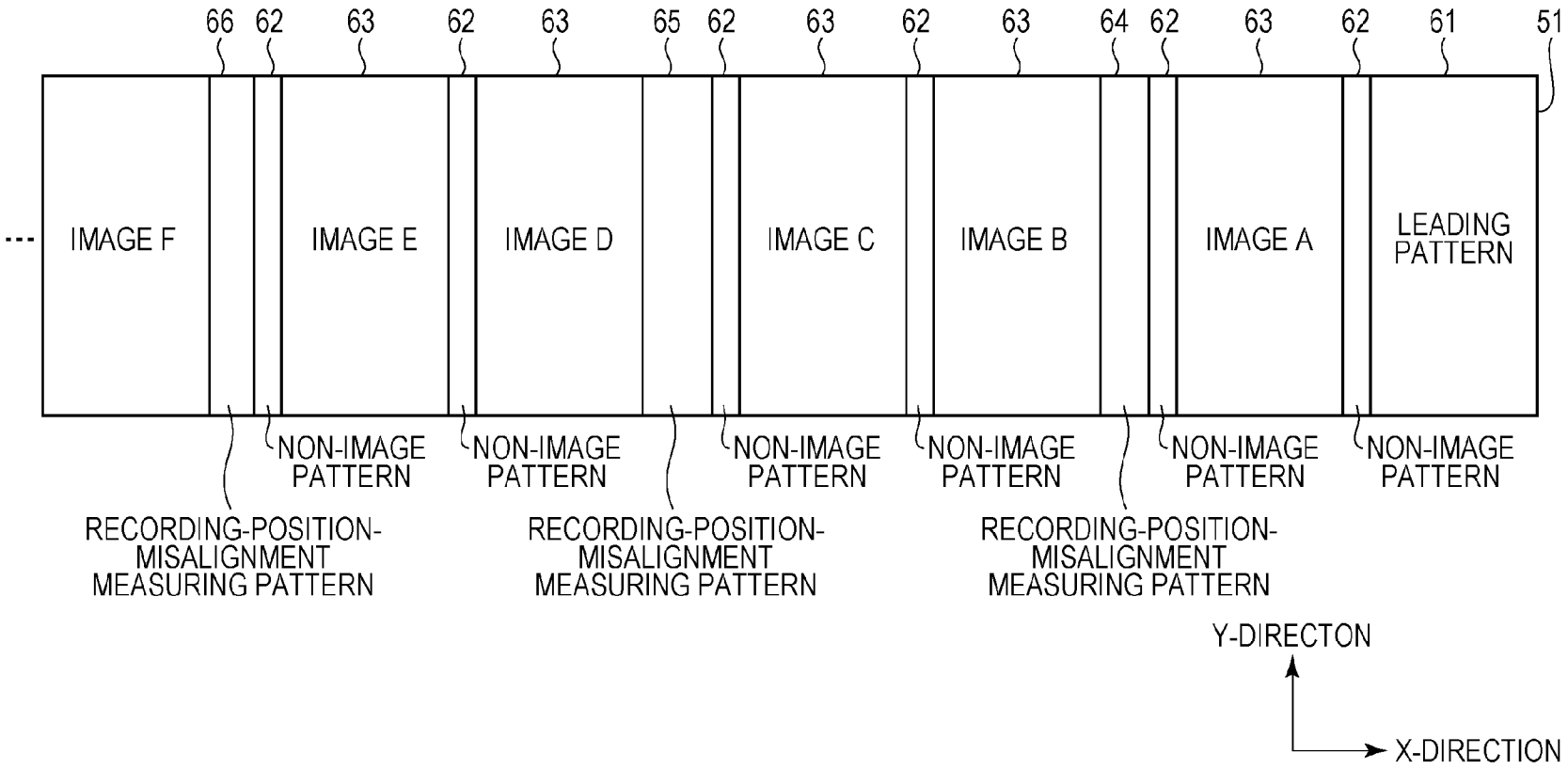
FIG. 7 is a diagram illustrating the layout of print patterns in a first embodiment.

FIG. 7 is a diagram illustrating a system for measuring the amounts of misalignment of recording positions for obtaining information on the amounts of misalignment. FIG. 7 shows the sheet 51 on which images and various patterns, described later, are recorded. Reference sign 61 denotes a leading pattern, which is a print pattern for a margin necessary for starting printing and preliminary ejection printing for recovering ejection performance. Here, the leading pattern 61 is provided at the leading end of the sheet 51 in the conveying direction. Reference sign 62 denotes a print pattern in a non-image portion for a cut mark for cutting the sheet 51 or for recovering ejection performance between images. Reference 63 denotes an image recording area in which an image that the user wants to record is formed. Reference signs 64 and 65 denote an area in which a recording-position-misalignment measuring pattern is formed. As shown in FIG. 7, the misalignment measuring pattern is recorded in anon-image portion between image recording areas at predetermined intervals. This is because a fixed time is required for a sequence of reading patterns, calculating the amounts of misalignment, and correction. By reading the recording-position-misalignment measuring patterns with the checking unit 5, the amounts of misalignment are calculated by the misalignment calculating section 23, as described above. The amount of misalignment calculated using the recording-position-misalignment measuring pattern in the area 64 is corrected by adjusting the recording position with the correcting section 24 serving as a recording-position adjusting unit. The correction is completed before the recording-position-misalignment measuring pattern in the area 65 is recorded at a predetermined time interval from the previous recording-position-misalignment measuring pattern (area 64). After the correction, an image in which the correction is reflected is recorded before the recording-position-misalignment measuring pattern (area 65) is recorded.

Figure 8:
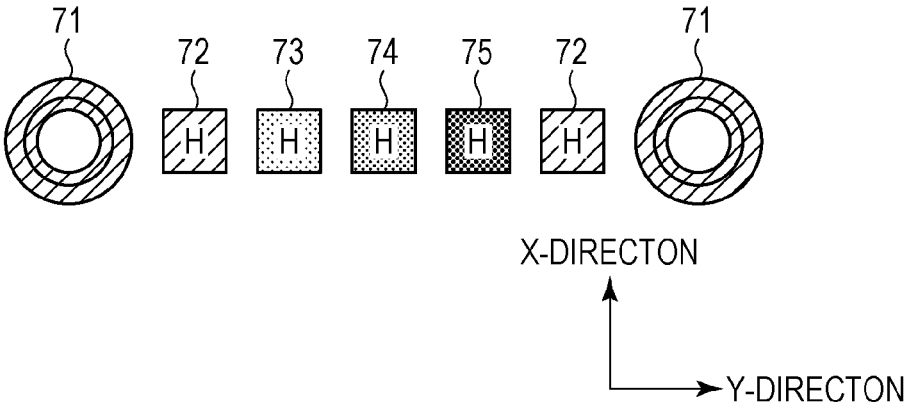
FIG. 8 is a diagram illustrating a landing-misalignment analyzing pattern.
Figure 9:
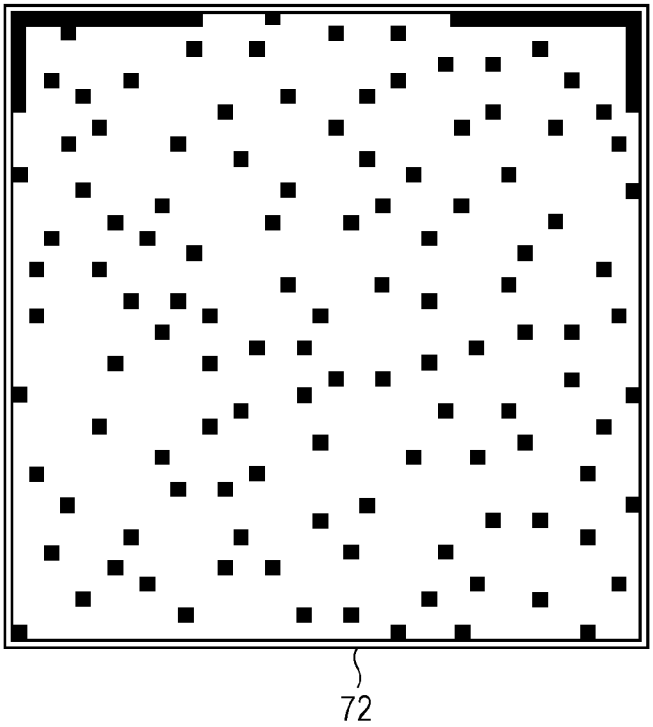
FIG. 9 is a diagram illustrating an example of a tile pattern.

FIG. 8 illustrates a recording-position-misalignment measuring pattern for measuring misalignment of a recording position to adjust the recording position. Reference sign 71 denotes a detection mark, which is a double circle pattern. The checking unit 5 detects the detection marks 71 in an image read by the CCD line sensor 17 and starts analysis. Reference signs 72, 73, 74, and 75 denote rectangular tile patterns included in the recording-position-misalignment measuring pattern, in which the tile pattern 72 is recorded in black (K), the tile pattern 73 in cyan (C), the tile pattern 74 in magenta (M), and the tile pattern 75 in yellow (Y). The positions of the tile patterns 72 to 75 are detected by pattern matching. The tile patterns of the individual colors are input to the recording heads 14 as data to be recorded at the same positions in the X-direction, and the recording heads 14 record the patterns on the basis of the input data. The amounts of misalignment in the X-direction between the patterns of the individual colors correspond to the amounts of misalignment of the recording positions to be corrected. All of the tile patterns 72 to 75 have the same dot patterns, which are recorded with nozzle arrays (in this embodiment, nozzle arrays H in the X-direction) at the same position of the recording heads 14 of the respective colors. In other words, the tile patterns 72 to 75 are recorded using nozzle arrays disposed at predetermined positions in the chips disposed at corresponding positions in the individual recording heads 14. In this embodiment, the tile patterns 72 to 75 are recorded side by side in the Y-direction without overlapping, using different portions of the nozzle arrays H at the lowermost stream positions in the conveying direction of the chips at the extreme ends in the Y-direction of the recording heads 14. The tile patterns 72 to 75 shown in FIG. 8 are random-dot patterns, as shown in FIG. 9. All the tile patterns 72 to 75 are recorded in the same pattern. This allows pattern matching among the tile patterns 72 to 75 to thereby calculate the distance (the number of pixels) between tile patterns having the highest correlation among the tile patterns 72 to 75. The amounts of misalignment are calculated from the difference between the number of pixels between tile patterns at ideal positions and the calculated number of pixels between the tile patterns. For the pattern matching, a general method as disclosed in Japanese Patent Laid-Open No. 2010-105203 may be adopted.

Figure 10:
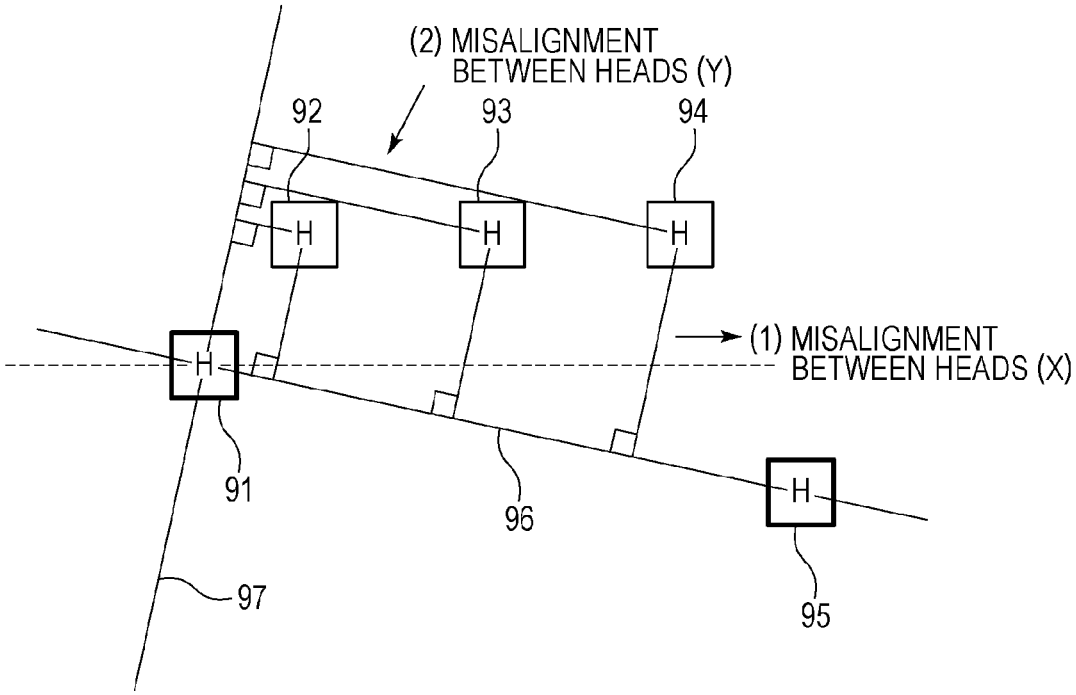
FIG. 10 is a diagram illustrating a method for calculating the amounts of misalignment.

Referring next to FIG. 10, a method for calculating the amounts of misalignment among the plurality of recording heads 14 will be described. The amounts of misalignment are determined from the relative positional relationship among the tile patterns 72 to 75 shown in FIG. 8. In this embodiment, the amounts of misalignment among the recording heads 14 are obtained by calculating the amounts of misalignment of the tile patterns recorded with the individual recording heads 14 relative to the tile patterns recorded with the recording head 14 for black (K). A perpendicular to a tile pattern 92 recorded with the recording head 14 for cyan (C) is connected to a straight line 96 connecting tile patterns 91 and 95 recorded with the nozzle arrays H of the recording unit 14 for black (K), and the length of the perpendicular is calculated. The difference between the length and a length at an ideal position is calculated as the amount of misalignment (X) between the recording head 14 for black (K) and the recording head 14 for cyan (C). A straight line 97 perpendicular to the straight line 96 is drawn from the tile pattern 91, and a perpendicular to the straight line 97 is drawn from the tile pattern 92, and the length of the perpendicular is calculated. The difference between the length and a length at the ideal position is calculated as the amount of misalignment (Y) between the recording head 14 for the black (K) and the recording head 14 for cyan (C). Also for the recording heads for magenta (M) and yellow (Y), the amounts of misalignment (X) and (Y) between them and the recording head 14 for black (K) can be calculated as for the recording head 14 for cyan (C).

Figure 11A:
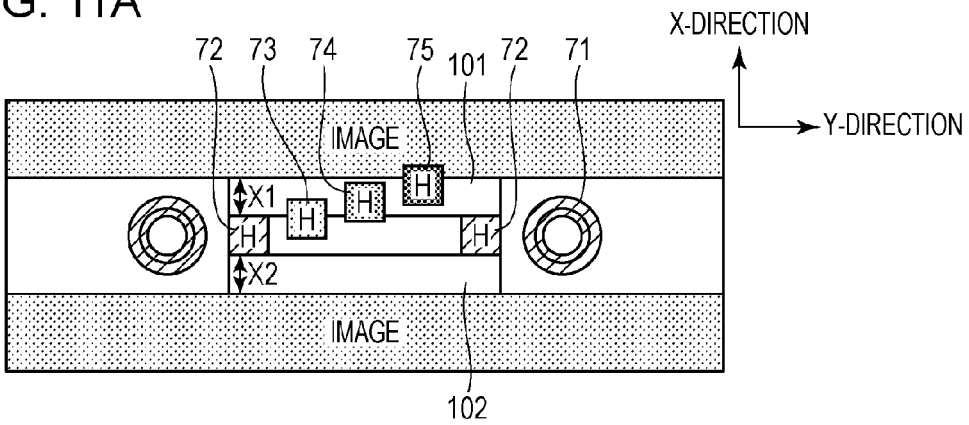
FIGS. 11A to 11C are diagrams illustrating the whole of a landing-misalignment analyzing pattern in the first embodiment.
Figure 11B:
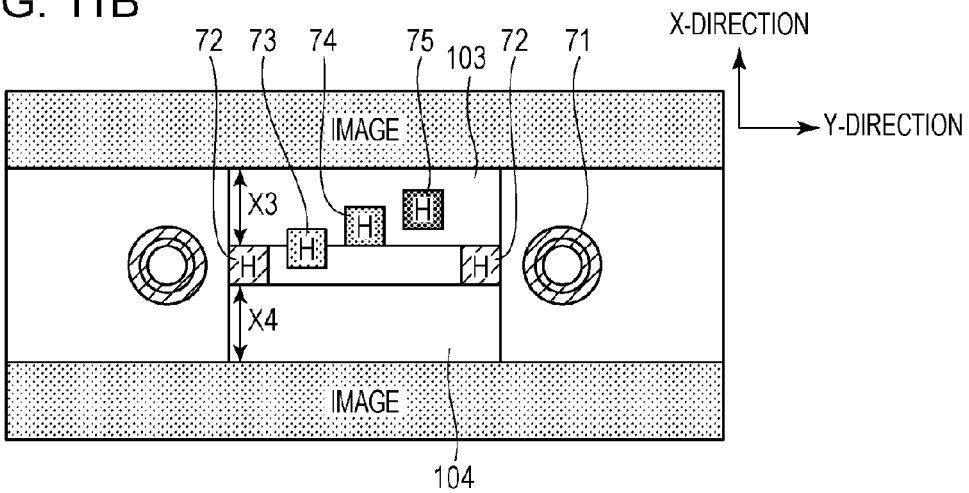
Figure 11C:
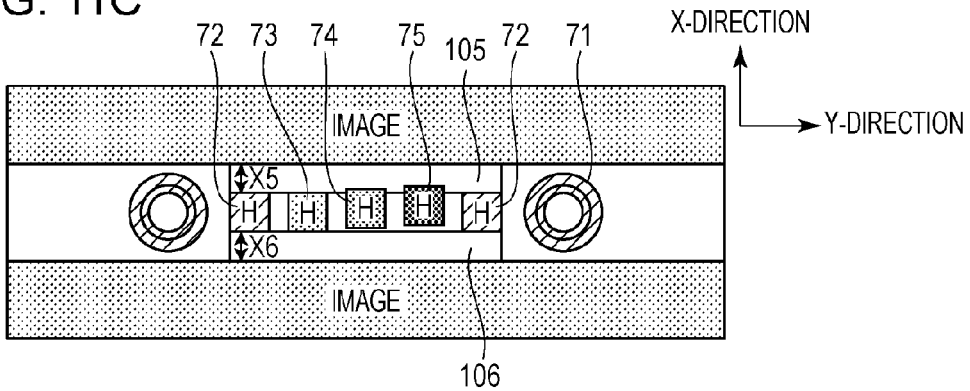

FIGS. 11A to 11C show the details of the recording-position-misalignment measuring patterns 64 to 66 shown in FIG. 7. FIG. 11A shows the recording-position-misalignment measuring pattern 64 in FIG. 7, FIG. 11B shows the recording-position-misalignment measuring pattern 65 in FIG. 7, and FIG. 11C is the recording-position-misalignment measuring pattern 66 in FIG. 7. Portions 101 and 102 in FIG. 11A, 103 and 104 in FIG. 11B, and 105 and 106 in FIG. 11C are margins for analyzing the amounts of misalignment.

In FIG. 11A, the tile pattern 75 overlaps with an image. This is because a change in conveying speed increases the amount of misalignment in the conveying direction with increasing distance from the upstream recording head 14 for black, thus causing an image recorded by the recording head 14 for black and the yellow tile pattern 75 to overlap. Overlapping of a tile pattern and an image precludes correct pattern matching. This makes it impossible to analyze the amount of misalignment, thus causing an analytical error. Thus, upon detection of such a state, sufficient margins for analyzing the amounts of misalignment, like the portions 103 and 104 in FIG. 11B, are provided at the recording of the next recording-position-misalignment measuring pattern. When the recording-position-misalignment measuring pattern 65 in FIG. 7 is to be recorded, the length in the X-direction of the recording area of the recording-position-misalignment measuring pattern is determined on the basis of the result of reading the preceding recording-position-misalignment measuring pattern 64. If it is determined that the amounts of misalignment in the recording-position-misalignment measuring pattern 64 are so large that a correct analysis is impossible, the margins of the recording-position-misalignment measuring pattern 65 are relatively increased to allow a correct analysis. In other words, the lengths of the portions 103 and 104 are increased relative to the lengths of the portions 101 and 102. This can prevent an error in analyzing the recording-position-misalignment measuring pattern 65.

In FIG. 11B, the margins for analyzing the amounts of misalignment are sufficient, so that the amounts of misalignment can be correctly analyzed. This allows the recording-position-misalignment measuring pattern 66 to reflect the result of the analysis of the recording-position-misalignment measuring pattern 65. This can decrease the amounts of misalignment of the recording-position-misalignment measuring pattern 66 relative to the amounts of misalignment of the recording-position-misalignment measuring pattern 65, thus allowing the portions 105 and 106 to be smaller than the portions 103 and 104 (see FIG. 11C). Thus, minimizing the non-image portions by optimizing the lengths of the patterns 64 to 66 can reduce consumption of the sheet 51.

If a recording-position-misalignment measuring pattern recorded after the recording-position-misalignment measuring pattern 66 is as shown in FIG. 11A, a recording-position-misalignment measuring pattern to be recorded next is set as shown in FIG. 11B so that the amount of misalignment can be correctly analyzed. This allows the following recording-position-misalignment measuring pattern to be set as shown in FIG. 11C.

Figure 12:
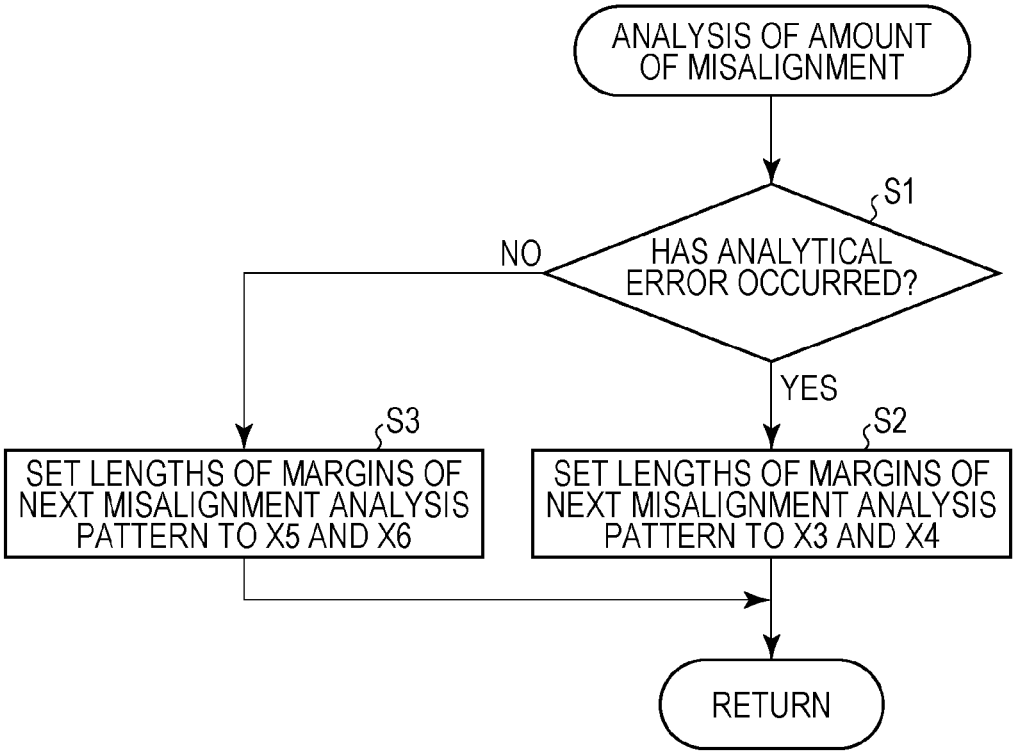
FIG. 12 is a flowchart of the control in the first embodiment.

FIG. 12 is a flowchart of the control in this embodiment. The sequence of the control is described above. In the case where the amounts of misalignment is so large that the amounts of margins come short, causing an analytical error, the lengths of the margins are increased to X3 and X4 (S1 and S2). If the amounts of misalignment can be analyzed, the analysis can be reflected to correction of the next analysis pattern, and the lengths of the margins are decreased to X5 and X6 (S3).

Figure 13A:
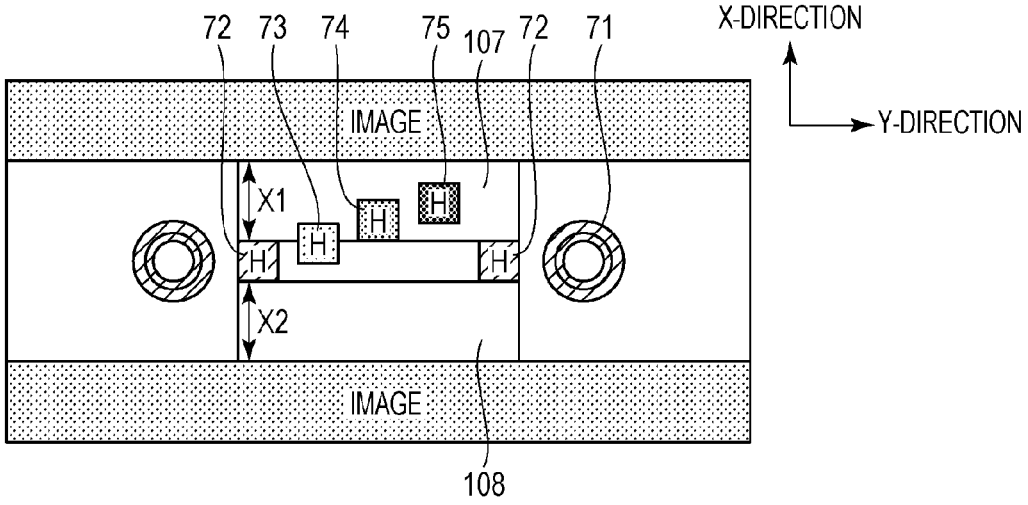
FIGS. 13A and 13B are diagrams illustrating, in outline, detection of a cut mark.
Figure 13B:
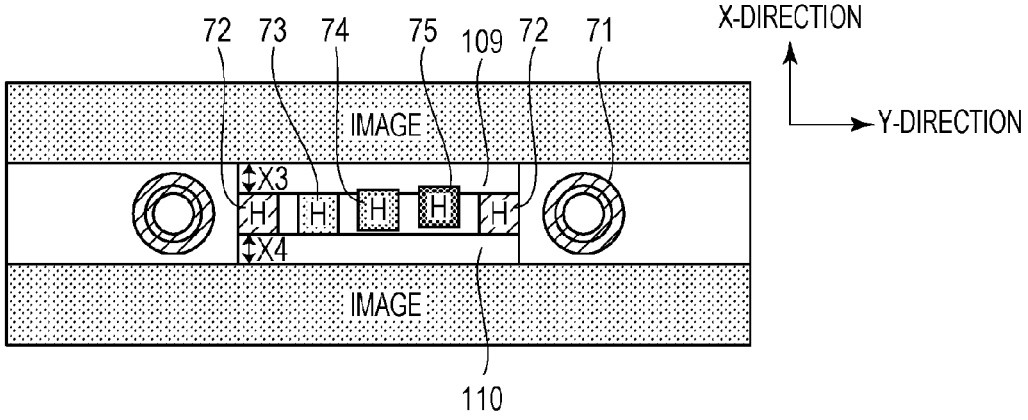

The first analysis pattern may be an error because it is not corrected using the previous analysis. In other words, the first analysis pattern cannot be correctly analyzed because the lengths X1 and X2 of the portions 101 and 102 of the recording-position-misalignment measuring pattern 64 are short. Therefore, for the first analysis pattern, the lengths X1 and X2 may be set large in advance, as shown in FIG. 13A, to prevent an analytical error.

A method for determining the lengths X1 and X2 will be described. The conveying speed changes depending on the moisture state, the kind, and the width of paper, and so on. These factors change the hardness of the paper and friction between conveying rollers and the paper to change the conveying speed. Therefore, the lengths X1 and X2 are set in consideration of these errors and a change in conveying speed from the start of recording to the recording-position-misalignment measuring pattern 64.

A specific method for determining the lengths X1 and X2 is based on a conveying speed at the start of printing estimated from the kind and width of paper.

Although this is a typical embodiment of the present invention, the present invention should not be limited to the above and can be appropriately modified without departing from the spirit and scope of the present invention. For example, although the above embodiment shows an example in which the checking unit 5 is a CCD line sensor, it may be a CMOS sensor.

Although the recording-position-misalignment measuring patterns are recorded in non-image portions at fixed intervals, they may not necessarily be recorded at fixed intervals. The recording-position-misalignment measuring patterns may be recorded either in all of a plurality of non-image portions or in every several (for example, three) non-image portions. The number of the several non-image portions in which no recording-position-misalignment measuring pattern is recorded may be varied.

Although the measurement of the amounts of misalignment of a recording position during recording is based on an analysis of the amounts of misalignment among recording heads, the present invention should not be limited thereto; the measurement may be based on an analysis of the amounts of misalignment in recording heads, for example, the amounts of misalignment among nozzle arrays or chips.

Although a random tile pattern is given as an example, the present invention is not limited thereto. Although the tile pattern is recorded with reference to the nozzle array H, any other nozzle arrays may be used as reference. Although the amounts of misalignment among recording heads are analyzed with reference to the recording head for black (K), any other recording heads may be used as reference.

Although a method for determining the lengths X1 and X2 depending on the kind and width of paper is given, the present invention is not limited thereto. The lengths X1 and X2 may be determined by storing the history of an analysis of landing-misalignment analysis patterns in the ROM 202 and estimating the conveying speed from the history of the past analysis before the recording-position-misalignment measuring pattern 64 is recorded.

Since the conveying speed changes depending on the conveying distance between images, the lengths X1 and X2 may be determined depending on the length of an image before a recording-position-misalignment measuring pattern is recording.

A unit for measuring the conveying speed of the recording medium may be provided to determine the lengths X1 and X2 from the measured conveying speed.

The recording heads may not necessarily have the above configuration (see FIG. 4); for example, the overlapping portions may be omitted. In other words, the nozzles of each chip need only to be arrayed so that recording can be performed across the entire width of the recording medium.

Second Embodiment

Figure 14:
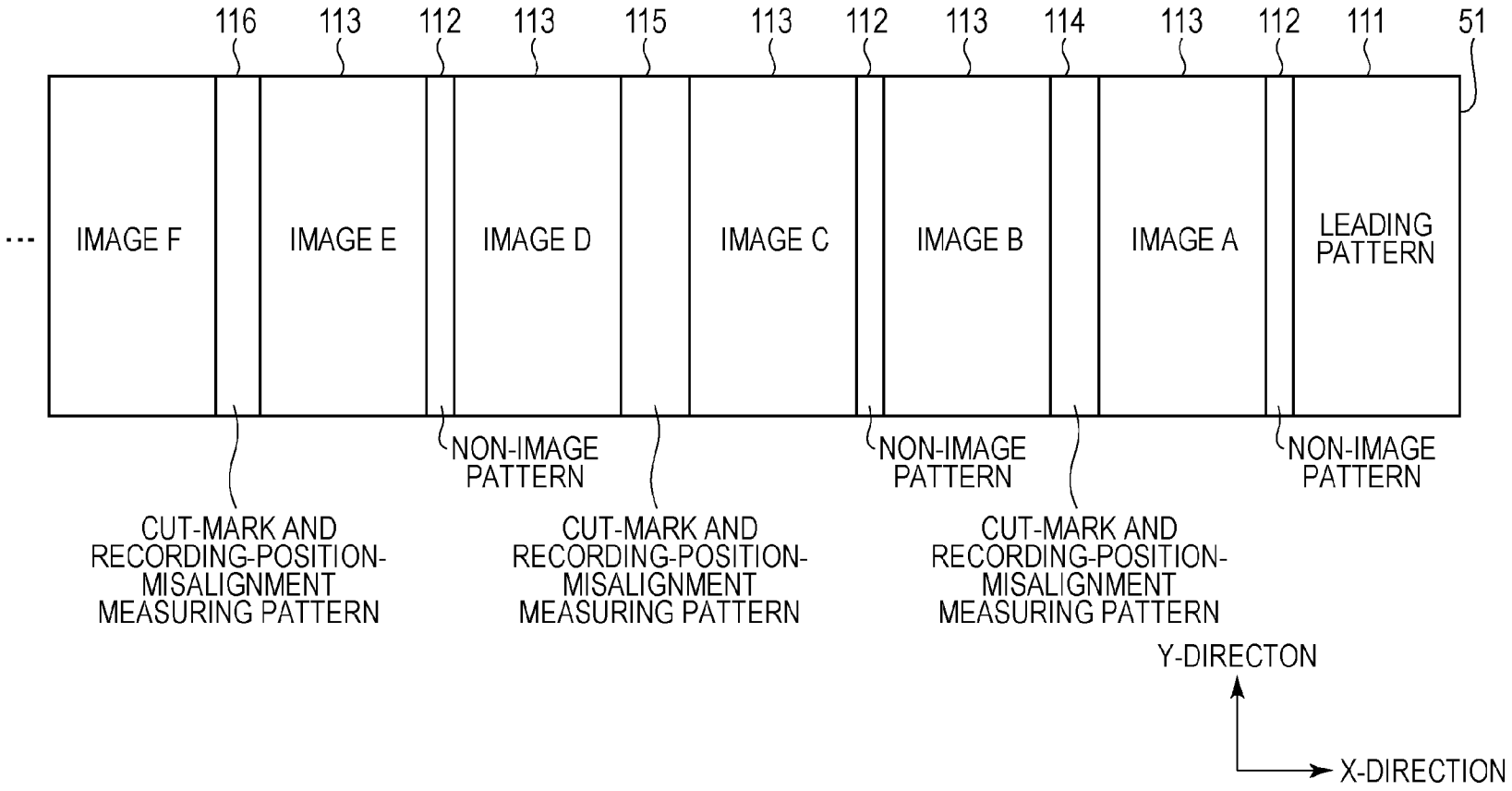
FIG. 14 is a diagram illustrating the layout of print patterns in a second embodiment.

The basic configuration of the apparatus and control in the second embodiment are the same as those in the first embodiment. In this embodiment, recording areas for recording-position-misalignment measuring patterns in non-image areas will be described. FIG. 14 illustrates measurement of landing misalignment in the second embodiment. In the second embodiment, recording-position-misalignment measuring patterns are recorded in part of areas 114, 115, and 116 in non-image areas in which a cut mark pattern is recorded. Non-image pattern areas 112 are printed with a print pattern for recovering ejection performance.

Figure 15A:
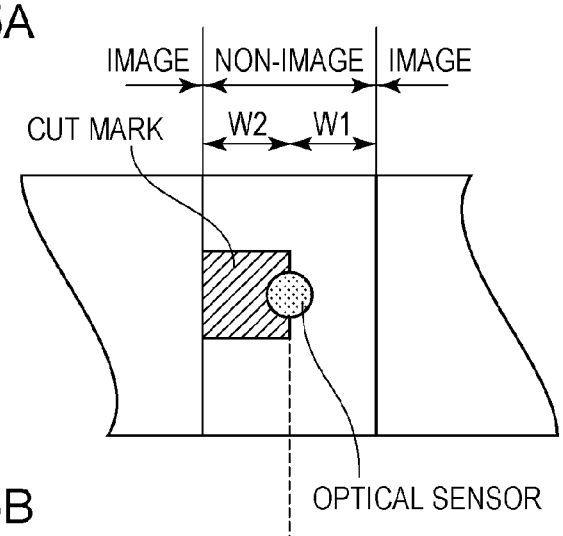
FIG. 15A is a diagram illustrating the positional relationship between a cut mark pattern and an optical sensor.
Figure 15B:
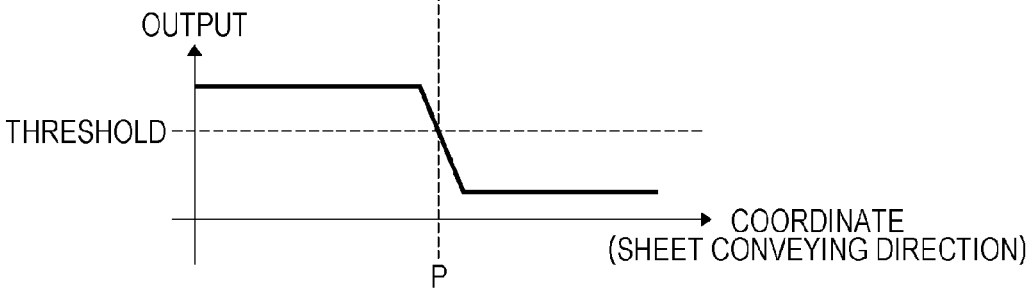
FIG. 15B is a diagram illustrating the output level of the optical sensor.

Next, a cut mark will be described. The cutter unit 6 of the ink-jet recording apparatus 20 shown in FIG. 1 has an optical sensor (not shown) that reads a cut mark pattern. FIGS. 15A and 15B illustrate the relationship between the cut mark pattern and the optical sensor. FIG. 15A is a diagram illustrating the positional relationship between the cut mark pattern and the optical sensor, and FIG. 15B is a diagram illustrating the output level of the optical sensor. As shown in FIG. 15A, the non-image portion for the cut mark pattern is constituted by an area W2 in which the cut mark pattern is recorded and a blank area W1. In this embodiment, the cut mark pattern is a monochrome black ink solid patch. The output level when a recording medium is conveyed to the cutter unit 6 is shown in FIG. 15B. A position P in FIG. 15B corresponds to the position of the optical sensor. The output downstream from the position P in the sheet conveying direction is low, and the output upstream therefrom is high. Setting a threshold value between the output level when the optical sensor of the cutter unit 6 reads a margin and that when reading a cut mark pattern allows detection of passage of the cut mark pattern through the optical sensor of the cutter unit 6. At that timing, the cutter unit 6 cuts the recording medium.

The width of the blank area W1 shown in FIG. 15A is set to a value factoring an error in the amount of conveyance of the recording medium. This setting information is stored in the RAM 203 or the HDD 204 in advance. The number of lines in a raster in which the cut mark pattern is recorded is sent from the CPU 201 to the scanner control portion 209 (not shown) that controls the cutter unit 6. The scanner control portion 209 controls the cutter unit 6 on the basis of the notified number of lines so as to enable the optical sensor in the cutter unit 6 to perform reading when the area in which the cut mark pattern is recorded is conveyed to an optical-sensor reading area of the cutter unit 6. When an area of the recording medium other than the area in which the cut mark pattern is recorded passes through the optical-sensor reading area of the cutter unit 6, reading with the optical sensor of the cutter unit 6 can be rejected.

Figure 16A:
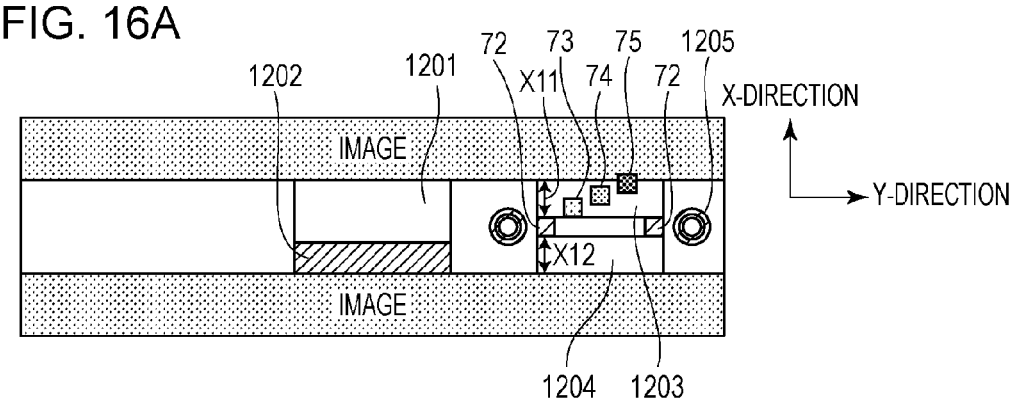
FIGS. 16A through 16C are diagrams illustrating examples of recording-position-misalignment measuring patterns according to the second embodiment.
Figure 16B:
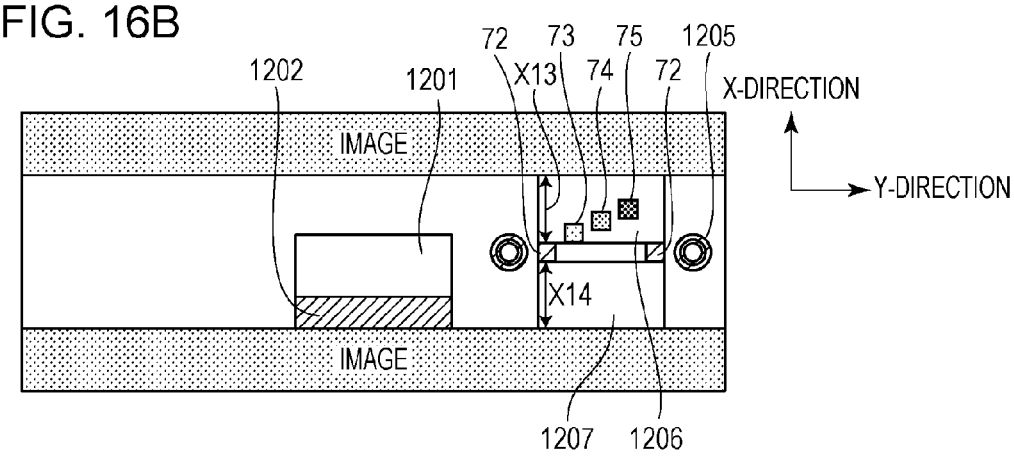
Figure 16C:
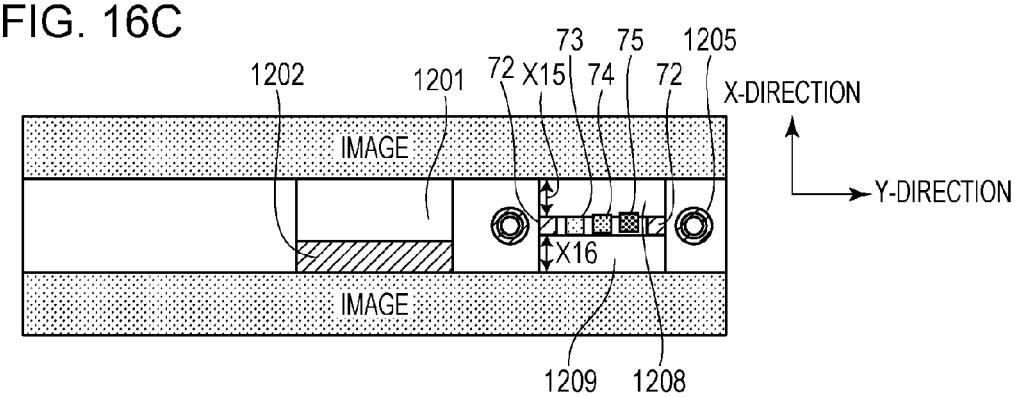

FIGS. 16A to 16C illustrate recording-position-misalignment measuring patterns 114 to 116 according to the second embodiment. FIG. 16A shows the recording-position-misalignment measuring pattern 114 in FIG. 14, FIG. 16B shows the recording-position-misalignment measuring pattern 115 in FIG. 14, and FIG. 16C shows the recording-position-misalignment measuring pattern 116 in FIG. 14. Reference sign 1201 denotes the margin shown in FIG. 15A, and 1202 denotes the cut mark pattern. Reference sign 1205 denotes the recording-position-misalignment measuring pattern shown in FIG. 8, which is recorded in an area shifted in the Y-direction from the margin 1201 and the cut mark pattern 1202. Reference signs 1203 and 1204 in FIG. 16A, 1206 and 1207 in FIG. 16B, and 1208 and 1209 in FIG. 16C denote margins for analyzing the amounts of misalignment. With the pattern 114 in FIG. 14, the amounts of landing misalignment is large as shown in FIG. 16A, so that the amounts of landing misalignment cannot be correctly analyzed. Subsequent recording of the recording-position-misalignment measuring pattern 115 reflects the analysis of the recording-position-misalignment measuring pattern 114 in FIG. 14. If it is determined that the misalignment in the recording-position-misalignment measuring pattern 114 in FIG. 14 is so large that correct analysis is impossible, the margin of the recording-position-misalignment measuring pattern 115 in FIG. 14 (FIG. 16B) is increased to allow correct analysis. Specifically, the length (X13) of the margin 1206 and the length (X14) of the margin 1207 are increased relative to the length (X11) of the margin 1203 and the length (X12) of the margin 1204, respectively. This allows the recording-position-misalignment measuring pattern 115 to be placed in an area between the images. Thus, the use of the recording-position-misalignment measuring pattern 115 (FIG. 14) allows the amounts of landing misalignment to be measured without an error in analyzing the recording-position-misalignment measuring pattern 115.

The recording-position-misalignment measuring pattern 115 in FIG. 16B has sufficient margins for analyzing the amounts of misalignment, allowing correct analysis of the amounts of landing misalignment. This allows the recording-position-misalignment measuring pattern 116 (FIG. 16C) to reflect the analysis of the recording-position-misalignment measuring pattern 115 (FIG. 14). This can decrease the amounts of misalignment among the colors in the recording-position-misalignment measuring pattern 116 of (FIG. 14) relative to the amounts of misalignment among the colors in the recording-position-misalignment measuring pattern 115

(FIG. 14). This can decrease the length (X15) of the margin 1208 and the length (X16) of the margin 1209 in FIG. 16C relative to the length (X13) of the margin 1206 and the length (X14) of the margin 1207, respectively. Thus, appropriately setting the lengths of the recording-position-misalignment measuring patterns can reduce an increase in the lengths of the non-image portions, thus preventing an increase in waste-paper.

This embodiment allows measurement of misalignment of recording positions without providing additional recording areas only for recording-position-misalignment measuring patterns by recording the recording-position-misalignment measuring patterns in cut-mark pattern areas, as described above.

Although this embodiment shows an example in which the recording-position-misalignment measuring patterns are recorded in cut-mark pattern areas, the present invention is not limited thereto; they may be recorded part of non-image patterns having another function. For example, they may be patterns for recovering ejection performance or patterns for determining the state of ejection.

The present invention can provide a recording position at which a detection pattern can be formed in an appropriate area with lower consumption of a recording medium.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-257154, filed Dec. 12, 2013, which is hereby incorporated by reference herein in its entirety.

What is claimed is:

1. A recording apparatus comprising:

a plurality of ink ejecting nozzles arrayed in a first direction, the nozzles having a first nozzle array and a second nozzle array disposed in a second direction perpendicular to the first direction, and the recording apparatus ejecting ink from the nozzles of the first nozzle array and the second nozzle array to record images on a recording medium while conveying the recording medium in the second direction;

a recording control unit configured to control recording with the first and second nozzle arrays so that a plurality of alignment measuring patterns are recorded between recording areas of the images on the recording medium at predetermined intervals, the patterns being for obtaining information on an amount of misalignment in the second direction on the recording medium between a position of recording with the first nozzle array and a position of recording with the second nozzle array, and to control the recording so that, after the patterns are recorded, the plurality of images are recorded upstream from the recording areas of the patterns in the second direction, respectively;

an acquisition unit configured to obtain the information on a basis of a result of reading the patterns; and an adjusting unit configured, in recording with the first nozzle array and the second nozzle array performed after the recording of a first pattern of the patterns, to adjust the relative recording positions of the first nozzle array and the second nozzle array on the basis of the information obtained by the acquisition unit and the corresponding amount of misalignment, wherein if the acquisition unit cannot obtain the information on the basis of the result of reading the first pattern, the adjusting unit does not perform the adjustment, and the next time, the recording control unit controls the recording so that a second pattern is recorded in a recording area longer in the second direction than the recording area of the first pattern.

2. The recording apparatus according to claim 1, wherein if the acquisition unit obtains the information on the basis of the result of reading the first pattern of the patterns, the adjusting unit adjusts the recording position of the first pattern, and the next time, the recording control unit controls the recording on the basis of the adjustment with the adjusting unit so that a second pattern is recorded in a recording area shorter in the second direction than the recording area of the first pattern.

3. The recording apparatus according to claim 1, wherein the recording areas of the patterns are each next to the recording area of one of the images in the second direction.

4. The recording apparatus according to claim 1, wherein if the acquisition unit cannot obtain the information on the basis of the result of reading the first pattern, the adjusting unit does not perform the adjustment, and the recording control unit controls the recording so that two images that flank the second pattern are recorded in such a manner that the distance between recording areas of the two images is larger than the distance between recording areas of images that flank the first pattern.

5. The recording apparatus according to claim 1, wherein the recording control unit controls the recording so that the patterns including a predetermined dot pattern through the use of the first nozzle array and a predetermined dot pattern through the use of the second nozzle array are recorded; and the acquisition unit obtains the information by detecting the plurality of dot patterns by a pattern matching method.

6. The recording apparatus according to claim 1, further comprising:

a reading unit configured to read the patterns optically, wherein the acquisition unit obtains the information on the basis of the result of reading the patterns with the reading unit.

7. The recording apparatus according to claim 1, wherein the first nozzle array and the second nozzle array are nozzle arrays for ejecting different colors of ink.

8. The recording apparatus according to claim 1, wherein the first nozzle array and the second nozzle array each have a length corresponding to a width of the recording medium in the first direction; and the recording control unit controls the recording so that the images and the patterns are recorded by one relative scanning of the first and second nozzle arrays and the recording medium.

9. The recording apparatus according to claim 1, further comprising:

a cutting unit configured to cut the recording medium, wherein the recording control unit controls the printing so that marks indicating positions of the recording medium to be cut by the cutting unit and patterns for measuring the amount of misalignment are recorded between the image recording areas in the first direction.

10. The recording apparatus according to claim 1, wherein the first pattern is at the front of the plurality of alignment measuring patterns in the recording medium conveyed in the second direction.

11. The recording apparatus according to claim 1, wherein one or more patterns of the plurality of alignment measuring patterns are printed in front of the first pattern in the recording medium conveyed in the second direction.

12. A recording apparatus comprising:

a plurality of ink ejecting nozzles arrayed in a first direction, the nozzles having a first nozzle array and a second nozzle array disposed in a second direction perpendicular to the first direction, and the recording apparatus ejecting ink from the nozzles of the first nozzle array and the second nozzle array to record images on a recording medium while conveying the recording medium in the second direction;

a recording control unit configured to control recording with the first and second nozzle arrays so that a plurality of alignment measuring patterns are recorded between recording areas of the images on the recording medium at predetermined intervals, the patterns being for obtaining information on an amount of misalignment in the second direction on the recording medium between a position of recording with the first nozzle array and a position of recording with the second nozzle array, and to control the recording so that, after the patterns are recorded, the plurality of images are recorded upstream from the recording areas of the patterns in the second direction, respectively;

an acquisition unit configured to obtain the information on a basis of a result of reading the patterns; and an adjusting unit configured, in recording with the first nozzle array and the second nozzle array performed after the recording of a first pattern of the patterns, to adjust the relative recording positions of the first nozzle array and the second nozzle array on the basis of the information obtained by the acquisition unit and the corresponding amount of misalignment, wherein if the acquisition unit obtains the information on the basis of the result of reading the first pattern, the adjusting unit adjusts the recording positions for the first pattern, and the next time, the recording control unit controls the recording on the basis of the adjustment with the adjusting unit so that a second pattern is recorded in a recording area shorter in the second direction than the recording area of the first pattern.

13. The recording apparatus according to claim 12, further comprising:

a cutting unit configured to cut the recording medium, wherein the recording control unit controls the printing so that marks indicating positions of the recording medium to be cut by the cutting unit and patterns for measuring the amount of misalignment are recorded between the image recording areas in the first direction.

14. The recording apparatus according to claim 12, wherein the first pattern is at the front of the plurality of alignment measuring patterns in the recording medium conveyed in the second direction.

15. The recording apparatus according to claim 12, wherein one or more patterns of the plurality of alignment measuring patterns are printed in front of the first pattern in the recording medium conveyed in the second direction.

16. A recording apparatus comprising:

a plurality of ink ejecting nozzles arrayed in a first direction, the nozzles having a first nozzle array and a second nozzle array disposed in a second direction perpendicular to the first direction, and the recording apparatus ejecting ink from the nozzles of the first nozzle array and the second nozzle array to record images on a recording medium while conveying the recording medium in the second direction;

a recording control unit configured to control recording with the first and second nozzle arrays so that a plurality of alignment measuring patterns are recorded between recording areas of the images on the recording medium at predetermined intervals, the patterns being for obtaining information on an amount of misalignment in the second direction on the recording medium between a position of recording with the first nozzle array and a position of recording with the second nozzle array, and to control the recording so that, after the patterns are recorded, the plurality of images are recorded upstream from the recording areas of the patterns in the second direction, respectively;

an acquisition unit configured to obtain the information on a basis of a result of reading the patterns; and an adjusting unit configured, in recording with the first nozzle array and the second nozzle array performed after the recording of a first pattern of the patterns, to adjust the relative recording positions of the first nozzle array and the second nozzle array on the basis of the information obtained by the acquisition unit and the corresponding amount of misalignment, wherein if the first pattern overlaps with the images, the recording control unit controls the recording so that a recording area of a second pattern in the second direction is longer than the recording area of the first pattern in the second direction.

17. The recording apparatus according to claim 16, wherein the first pattern is at the front of the plurality of alignment measuring patterns in the recording medium conveyed in the second direction.

18. The recording apparatus according to claim 16, wherein one or more patterns of the plurality of alignment measuring patterns are printed in front of the first pattern in the recording medium conveyed in the second direction.

19. A method for recording with a recording apparatus including a plurality of ink ejecting nozzles arrayed in a first direction, the nozzles having a first nozzle array and a second nozzle array disposed in a second direction perpendicular to the first direction, the method comprising the steps of:

ejecting ink from the nozzles of the first nozzle array and the second nozzle array to record images on a recording medium while conveying the recording medium in the second direction;

recording a plurality of alignment measuring patterns between recording areas of the images on the recording medium at predetermined intervals with the first and second nozzle arrays, the patterns being for obtaining information on an amount of misalignment in the second direction on the recording medium between a position of recording with the first nozzle array and a position of recording with the second nozzle array, and after the patterns are recorded, recording the plurality of images upstream from the recording areas of the patterns in the second direction, respectively, with the first and second nozzle arrays;

acquiring or obtaining the information on a basis of a result of reading the patterns; and in the recording with the first nozzle array and the second nozzle array performed after the recording of a first pattern of the patterns, adjusting the relative recording positions of the first nozzle array and the second nozzle array on the basis of the information obtained in the step of acquisition and the corresponding amount of misalignment, wherein if the information cannot be obtained on the basis of the result of reading the first pattern, the step of adjustment is not performed, and the next time, in the step of recording, a second pattern is recorded in a recording area longer in the second direction than the recording area of the first pattern.

20. The method according to claim 19, wherein the first pattern is at the front of the plurality of alignment measuring patterns in the recording medium conveyed in the second direction.

21. The method according to claim 19, wherein one or more patterns of the plurality of alignment measuring patterns are printed in front of the first pattern in the recording medium conveyed in the second direction.

* * * * *